US006056586A

United States Patent [19]

Lin

[11] Patent Number: 6,056,586

[45] Date of Patent: May 2, 2000

[54] ANCHORING MEMBER FOR A COMMUNICATION CABLE

[75] Inventor: Chen-Chieh Lin, Indianapolis, Ind.

[73] Assignee: Lucent Technologies Inc., Murray Hill, N.J.

[21] Appl. No.: 09/126,042

[22] Filed: Jul. 30, 1998

[51] Int. Cl.[7] ..... H01R 13/58

[52] U.S. Cl. ..... 439/460; 439/462

[58] Field of Search ..... 439/460, 461, 439/462, 805, 676, 610, 470

[56] References Cited

U.S. PATENT DOCUMENTS 5,211,576 5/1993 Tonkiss et al. ..... 439/462

5,573,423 11/1996 Lin et al. ..... 439/462

*Primary Examiner*—Hien Vu

*Assistant Examiner*—Alexander Gilman

[57] ABSTRACT

A communications cable anchoring member for use in a strain relief connector assembly is a compression ring which has an elongated body with front and rear faces and an axial bore extending between the faces. The bore forms a peripheral wall with the exterior of the body in which is an array of slots extending part of the distance between the faces. Alternate slots extend from opposite faces of the body. The exterior surface of the body is tapered to fit within the tapered bore of a strain relief plug of the connector, and latching members on the exterior surface latch the ring body to the plug.

14 Claims, 9 Drawing Sheets

ANCHORING MEMBER FOR A COMMUNICATION CABLE

CROSS-REFERENCE TO RELATED APPLICATION

This application is related to U.S. patent application Ser. No. 09/126,166 of C. C. Lin for "Strain Relief Apparatus For Use In A Communication Plug" (Lin Case 9), filed concurrently herewith.

FIELD OF THE INVENTION

The present invention relates generally to the field of communication connectors for terminating cables or conductors, and, more particularly to a cable anchoring member for anchoring the cable to a strain relief component of the connector.

BACKGROUND OF THE INVENTION

In the telecommunications industry, modular plug type connectors are commonly used to connect customer premise equipment (CPE), such as telephones or computers, to a jack in another piece of CPE, such as a modem, or in a wall terminal block. These modular plugs terminate essentially two types of cable or cordage: ribbon type cables and standard round or sheathed cables.

In ribbon type cables, the conductors running therethrough are arranged substantially in a plane and run, substantially parallel, alongside each other throughout the length of the cable. The individual conductors may have their own insulation or may be isolated from one another by channels defined in the jacket of the ribbon cable itself, with the ribbon cable providing the necessary insulation. Conversely, the conductors packaged in a standard round cable may take on a random or intended arrangement with conductors of conductor pairs being twisted or wrapped around one another and with the pairs changing relative positions throughout the cable length.

Most modular plugs are well suited for terminating ribbon type cables. Typically, these plugs are of a dielectric, such as plastic, structure in which a set of terminals are mounted side by side in a set of troughs or channels in the plug body such that the terminals match the configuration of the conductors in the cable connected thereto. When the plug is inserted into a jack, the terminals will electrically engage jack springs inside the jack to complete the connection.

A common problem found in these modular plugs is for the conductors to pull away or be pulled away from the terminals inside the plug structure. This can be caused by persons accidentally pulling on the cable, improperly removing the plug from a jack or merely from frequent use. The stress on the connections between the conductors and the plug terminals has been alleviated in prior art devices which include an anchoring member or anchor bar in the housing of the dielectric structure. In these designs, the dielectric structure, i.e., the plug, contains a chamber for receiving the cable. The cable is then secured within the chamber via pressure exerted upon the cable jacket by the anchoring member or anchor bar in conjunction with one or more of the chamber walls. U.S. Pat. Nos. 5,186,649 and 4,002,392 to Fortner et al. and Hardesty contain examples of such strain relief apparatus.

While these modular plugs with anchor bars have been effective in providing strain relief to ribbon type cables, standard round cables or cords pose additional strain relief problems. In U.S. patent application Ser. No. 08/922,621 of Chapman et al., filed Sep. 3, 1997, the disclosure of which is incorporated herein by reference, a plug for terminating a round cable has an anchor bar for holding the cable. While an anchor bar does function to secure the cable, it deforms the cable or cord and presses the individual leads together randomly. As a consequence there is introduced a random variable in performance of the plug as a result of increased cross talk among the conductors or leads, which can vary from cable to cable depending on the cut, and which, as a consequence, makes it difficult to predict a plug's electrical characteristics. The high degree of variability can also result in reduced signal carrying performance.

This process of terminating a round cable introduces significant variability in connecting the conductors to the plug terminals and places additional strain on the connections between the conductors and the plug terminals. Because the individual conductors in a conductor pair are often twisted around one another and the conductor pairs themselves are often twisted around one another, the conductor configuration a technician sees when the cable is cut prior to terminating changes based on the longitudinal position of the cut in the cable. The technician generally is forced to translate the conductor configuration into a side by side orientation matching the pattern of the terminals in the plug. Moreover, the necessity of splitting the conductors in at least one of the pairs, which is an industry standard, presents another potential for error in making the connections to the plug terminals. In addition, orienting the conductor positions from an essentially circular arrangement into a planar arrangement places additional stress on the conductor-terminal connections.

U.S. Pat. No. 5,496,196 to Winfried Schachtebeck discloses a cable connector in which the connector terminals are arranged in a circular pattern to match more closely the arrangement of conductors held in a round cable. However, the Schachtebeck invention attempts to isolate each individual conductor and apparently requires all conductor pairs to be split before termination to the connector.

In addition, the economic aspects of the prior art necessity for the installer to separate out the twisted pairs of conductors and route them to their proper terminals in the plug are of considerable moment. Even if the installer, splicer, or other operator is accurate in the disposition of the conductors, the time consumed by him or her in achieving such accuracy is considerable. Thus, in a single work day, the time spent in properly routing the conductors can add up to a large amount of time, hence money. Where it is appreciated that thousands of such connections are made daily, involving at least hundreds of installers, it can also be appreciated that any reduction in time spent in mounting the plug can be of considerable economic importance.

The plug should demonstrate predictable characteristics, including a minimization of any variation in signal transmission. Thus, the cable should be anchored to the plug in simple, economically viable construction readily adaptable for use in the field.

SUMMARY OF THE INVENTION

The present invention is a cable anchoring member for use in a plug such as a strain relief plug of a high frequency modular connector. The cable anchoring member of the invention comprises an elongated compression ring having a bore for passage of the cable therethrough. As shown in the copending U.S. patent application Ser. No. 09/126,166 of C. C. Lin, filed concurrently herewith and which is incorporated herein by reference, the strain relief plug has a bore into which the compression ring is to be inserted and which is tapered from a large cross section at the cable entrance end to a smaller dimension toward the connector end and, as a consequence, as the compression ring is pushed into the bore of the plug, compressive forces are exerted thereon which compress the ring and cause it to grip the cable tightly. The ring has a tapered outer surface in which there are several longitudinally extending slots which function to impart a greater compressibility to the ring to facilitate the cable gripping. The compressive forces applied to the ring and transmitted to the cable are, for a circular cable, or one approximating circular, uniformly distributed about the circumference of the cable jacket. As a consequence, there is a uniformity of pressure applied to the conductors within the cable which is substantially the same regardless of the conductor twisting. As a consequence, the variability in crosstalk and transmission characteristics typical of, for example, those connectors using anchor bars, is materially reduced.

The compression ring has, on one of its outer surfaces, such as the top surface, one or more latching members which are designed to mate with one or more latch openings in the strain relief plug housing to affix the compression ring to the housing in a manner that resists tensile forces on the cable.

The numerous features and advantages of the present invention will be more readily apparent from the following detailed description read in conjunction with the accompanying drawings.

DETAILED DESCRIPTION

Figure 1:
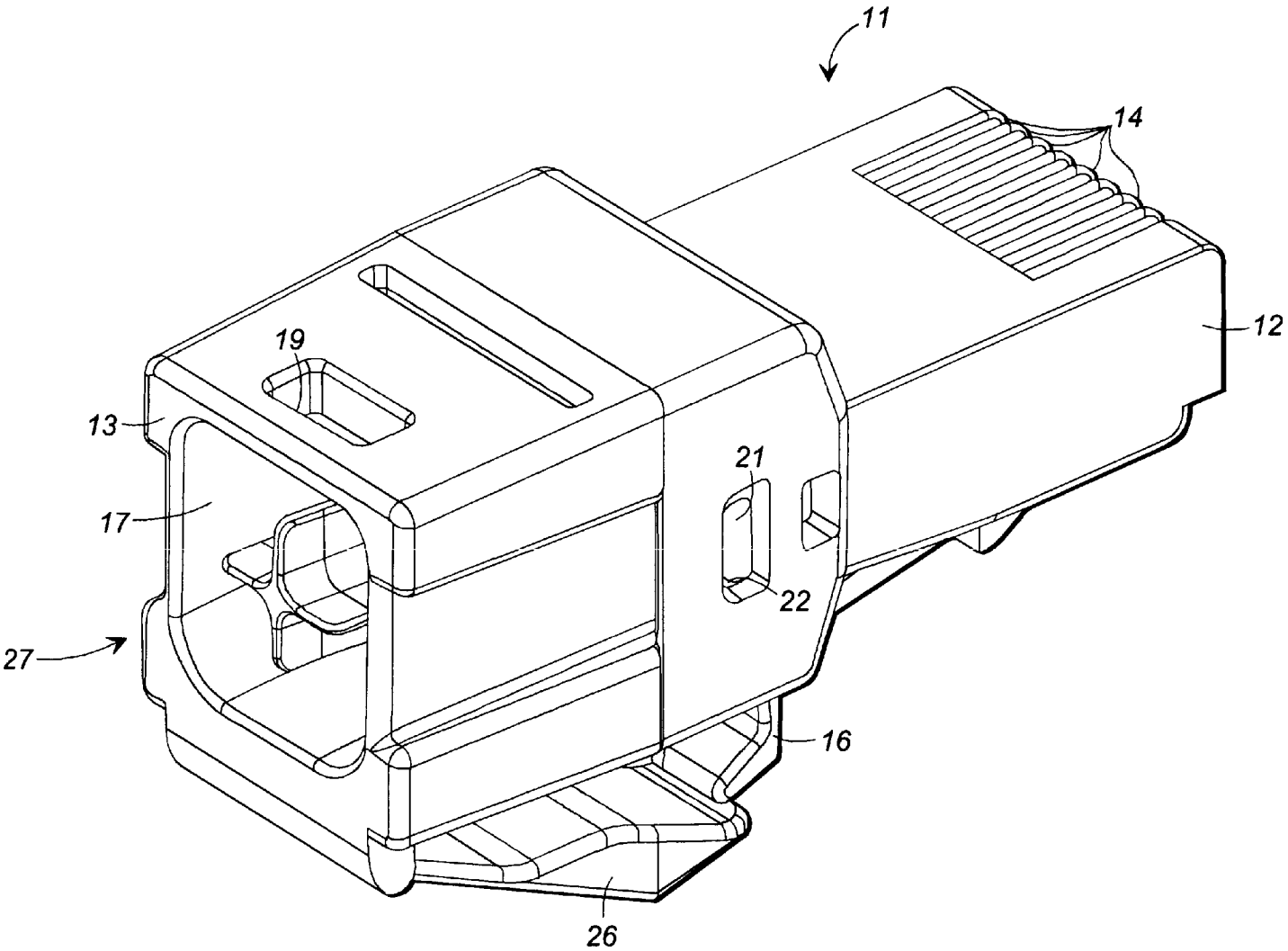
FIG. 1 is a perspective view of a modular communication connector having the strain relief plug for receiving the cable anchoring member of the presenting invention.

In FIG. 1 there is shown a high frequency communication plug connector 1 which comprises a jack interface housing 12 and a strain relief housing 13, both of which are preferably made of a suitable plastic material. Jack interface housing 12, which is substantially the same as the jack interface housing shown and described in the aforementioned Chapman et al. application Ser. No. 08/922,621 comprises a substantially hollow shell having side walls and upper and lower walls. A plurality of slots 14 on one end of housing 12 are adapted to receive jack springs contained in a terminal block or jack, not shown. The number of slots 14 and the dimensions of housing 12 are dependent on the number of conductors to be terminated or connected and the shape of the jack in the terminal block. Housing 12 includes a resilient latching arm 16 extending from the lower surface thereof at an angle, as shown. When housing 12 is inserted into a jack, pressure applied to the distal end of the arm 16 depresses it to facilitate entry into the jack, after which the pressure is removed and the arm 16 returns to its locking position as shown in FIG. 1, where it latches to the jack. Removal of housing 12 from the jack is accomplished by application of pressure on the distal end of arm 16, thereby unlatching it.

Figure 2A:
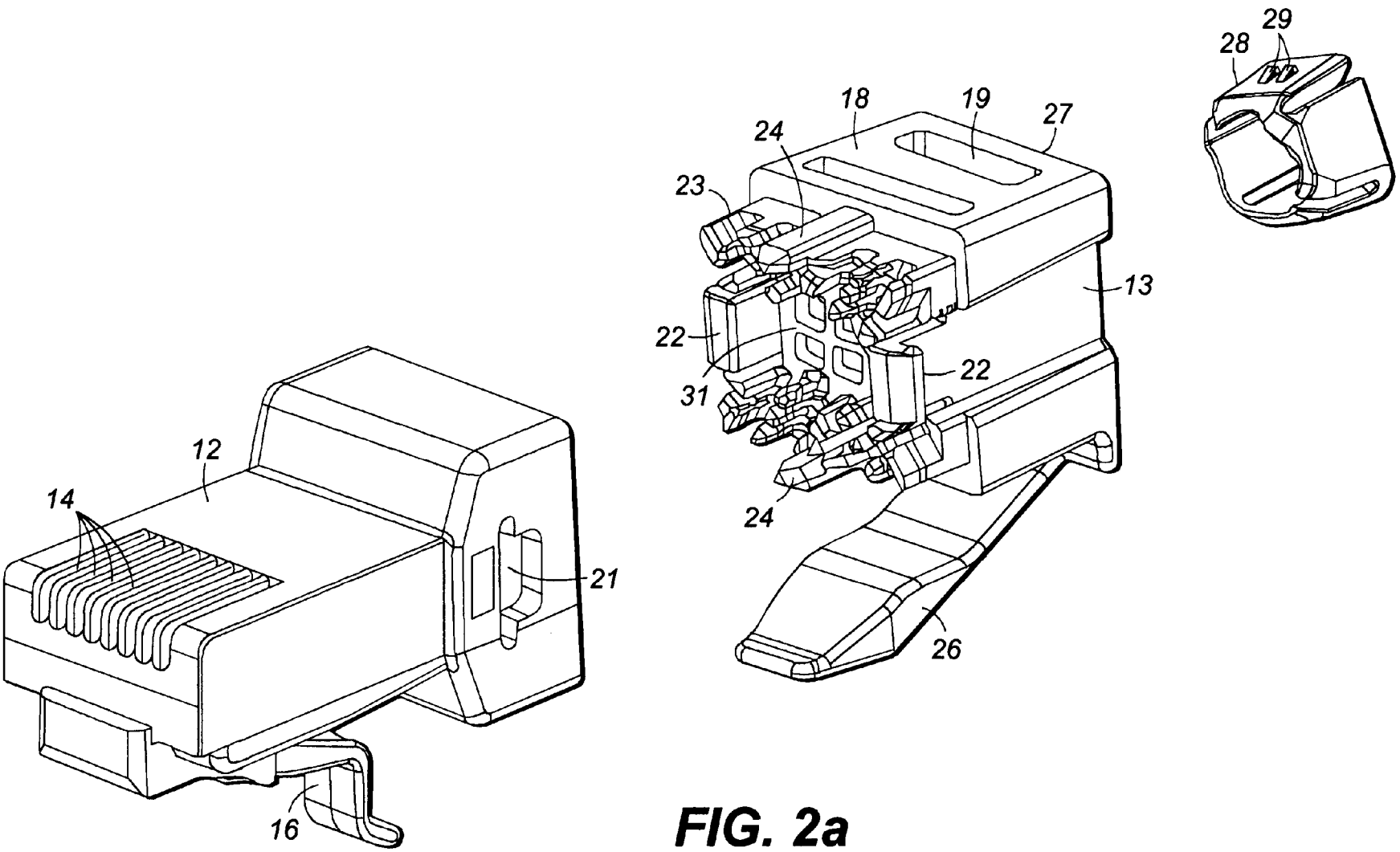
FIG. 2*a* is an exploded perspective view of the connector of FIG. 1.

The second major component of connector 11 is strain relief housing 13 which has a substantially rectangular opening 17 which, as will be discussed more fully hereinafter, provides entry for a cable containing conductors to be terminated. Within opening 17 is a cruciform system arrangement 20, which will be discussed in detail hereinafter. Opening 17 may have a rectangular or a circular cross-section. The top surface 18 of housing 13 has a rectangular opening 19 which, as will be explained hereafter, is involved in the strain relief feature of the invention. Two side apertures 21, only one of which is shown, in the side walls of housing 12 are for receiving spring latches 22 on either side of housing 13 to secure the two housings 12 and 13 together. As best seen in FIG. 2*a,* extending from the front or connector face 23 of housing 13 are alignment guides 24 which align with channels (not shown) in housing 12, as explained in the aforementioned Chapman et al application Ser. No. 08/922,621 to insure proper alignment of the two housings 12 and 13 when they are snapped together. For ease in removing connector 11 from a jack into which it is plugged, housing 13 is provided with a cantilevered trigger arm 26 which extends from the lower surface of housing 13 adjacent the cable receiving end 27 thereof, and at an angle thereto so that its distal end overlaps the distal end of latching arm 16, as seen in FIG. 1, when the housing 12 and 13 are latched together. Thus, arm or trigger 26 functions to actuate arm 16 and depress it to its release point when pressure is applied to arm 26. In addition to the convenience of such an arrangement, the overlap also prevents cables or wires from snagging on arm 16 or from lodging between arm 16 and housing 12, which presents a potential for damage to the connector or to the wires.

Figure 2B:
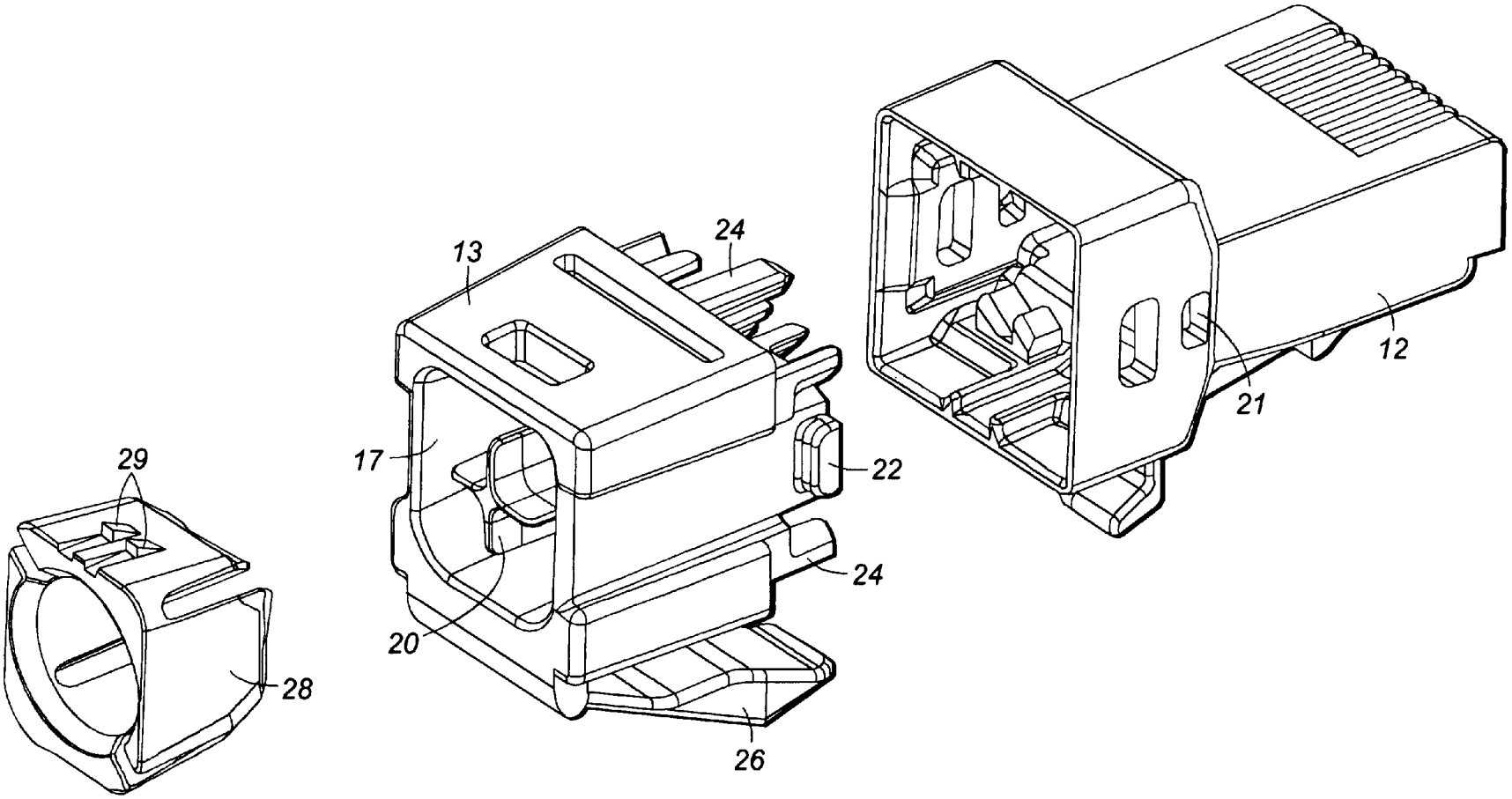
FIG. 2*b* is another exploded perspective view of the connector of FIGS. 1 and 2*a*, from a different angle of view.
Figure 2C:
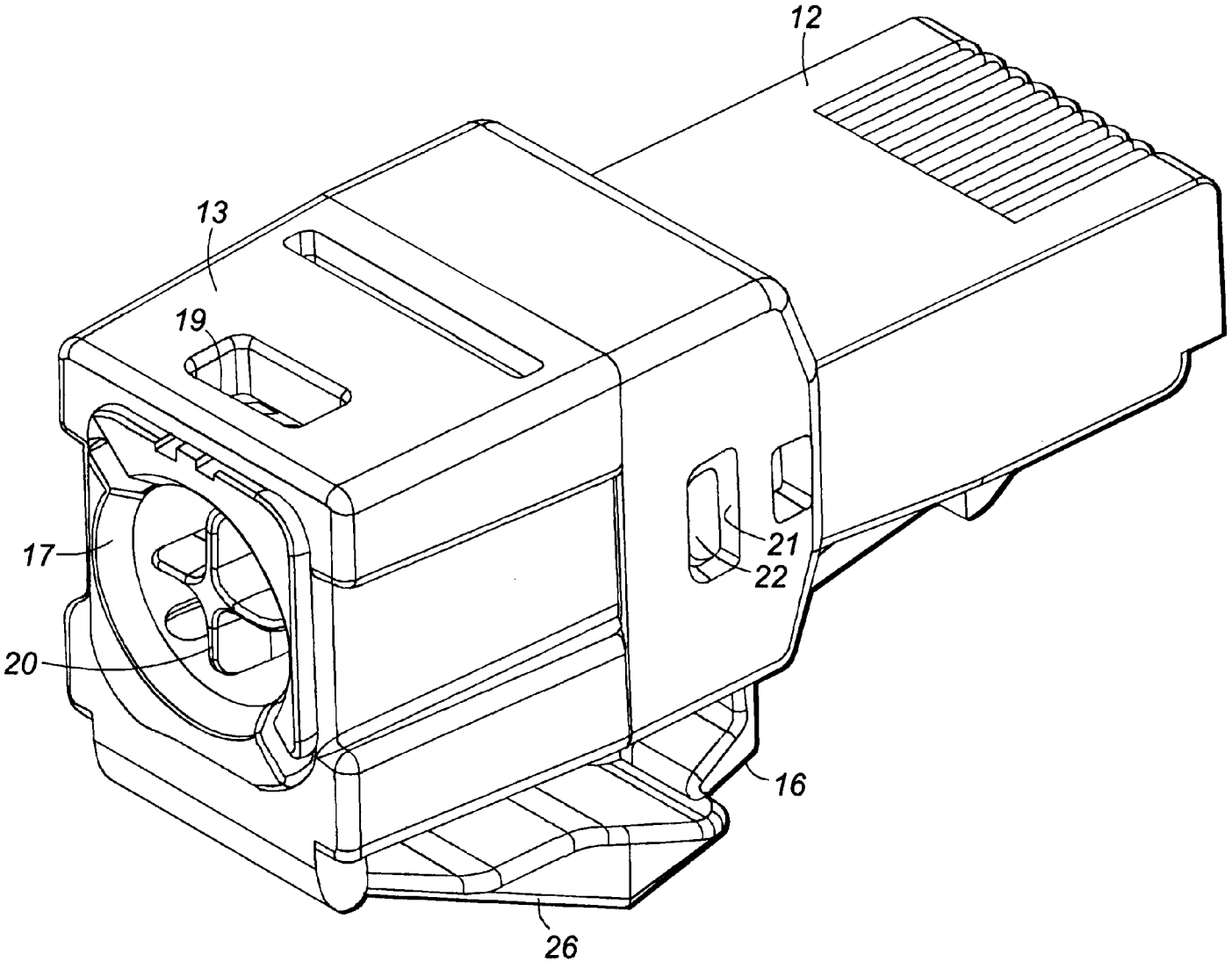
FIG. 2*c* is a perspective view of the connector of FIG. 1 with the compression ring of the invention in place.

As was discussed hereinbefore, and as shown in FIGS. 2*a* and 2*b*, the compression ring 28 of the invention is designed and configured to fit over the cable being terminated and to be insertable into the cable receiving end 27 of housing 13. When latched in place by means of latch projections 29 engaging the edge of opening 19, the cable is tightly but uniformly gripped and thus attached to housing 13 as will be explained in greater detail hereinafter. FIG. 2*c* illustrates the compression ring 28 in place within bore 17, but without the cable.

Figure 3:
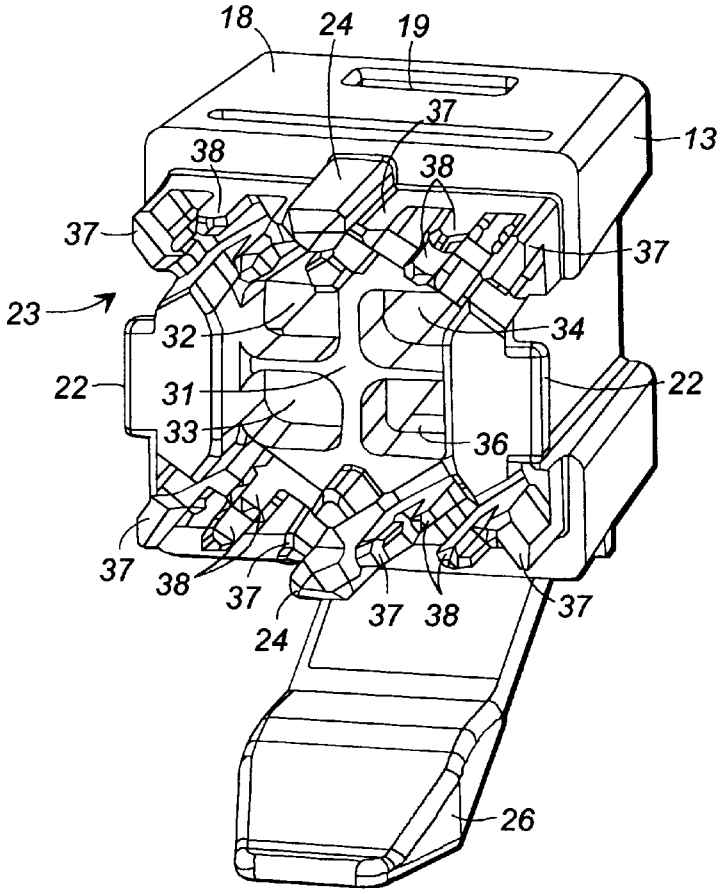
FIG. 3 is a perspective view of the front of the strain relief plug.
Figure 5:
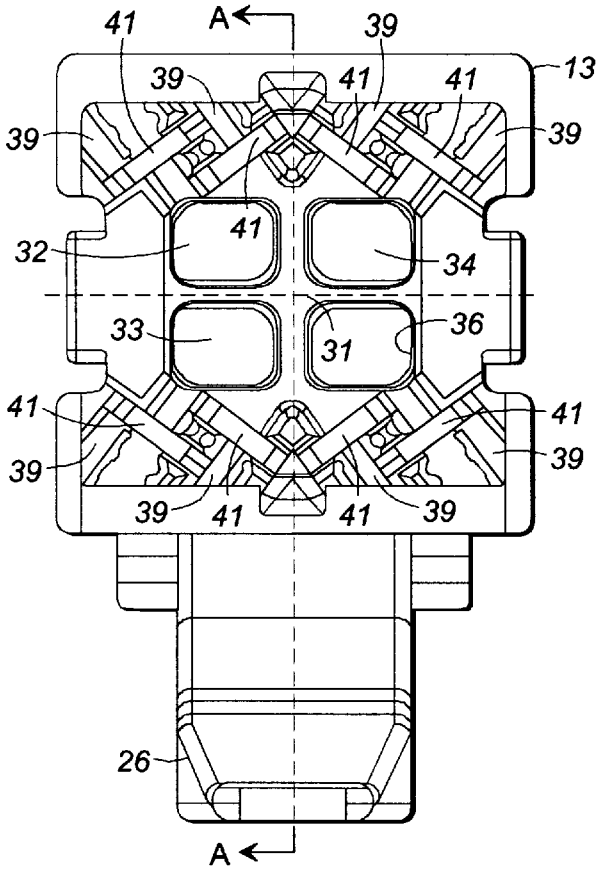
FIG. 5 is an elevation view of the front of the strain relief plug.

In FIG. 3, which is a perspective view of the plug 13 showing, in detail, the front or connector face 23 thereof, there is shown the arrangement for holding and organizing the individual wires carried by the cable being terminated, and FIG. 5 depicts the front face 23 in detail. Located within the interior bore 17 of plug 12 is a cruciform divider 31 which forms four substantially rectangular channels 32, 33, 34, and 36 for segregating pairs of wires (not shown) contained in the cable. In the illustrative embodiment shown, eight wires, or four pairs. Extending from the front face 23 are a plurality of conductor segregation prongs 37 and a plurality of conductor control channels 39, as is best seen in FIG. 5, for receiving and holding the insulated conductors from the cable. The prongs 37 and 38, and the channels 39, are radially spaced from the center of the divider 31, and these are two channels 39 for each of the openings 32, 33, 34, and 36. The segregation prongs 37 function to maintain each conductor pair separate from the other conductor pairs, and the separating prongs 38 function to separate the conductors in each pair from each other. The segregation prongs 37 are preferably larger than the separating prongs 38 so that crosstalk between conductor pairs is minimized. As will be more fully apparent hereinafter, the arrangement of a cruciform divider 31 and the prongs 37, 38, along with channels 39, materially simplify the organization of the conductors within the plug 13 which at the same time reducing crosstalk among the conductor pairs. The prongs 37 and 38 are bifurcated thereby forming insulation displacement connector (IDC) control channels 41, as best seen in FIG. 5 for receiving the IDC ends of conductive members contained in housing 12, which function to connect the ends of the cable conductors to the slots 14 and hence the jack springs, as explained in the Chapman et al. application Ser. No. 08/922,621. As can best be seen in FIG. 5, the positioning of the conductor pairs in, roughly, the four corners results in a radial array which greatly reduces the difficulties involved in routing the conductors from the cable. The separate channels formed by the openings 32, 33, 34, and 36, as will be discussed hereinafter, materially assist in achieving the proper routing.

Figure 4:
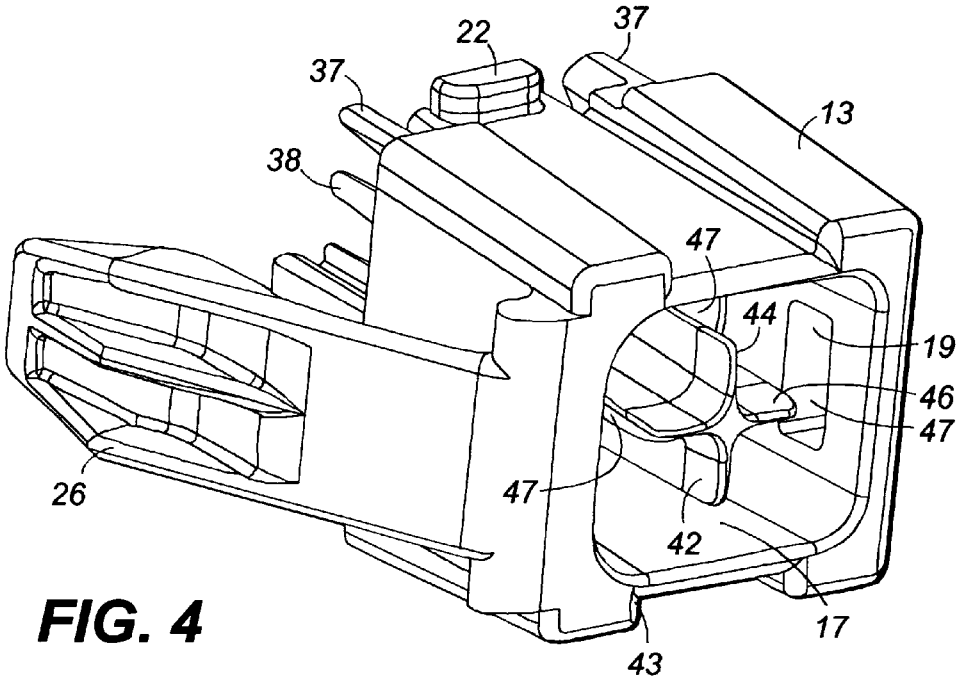
FIG. 4 is a perspective view of the rear of the strain relief plug.
Figure 6:
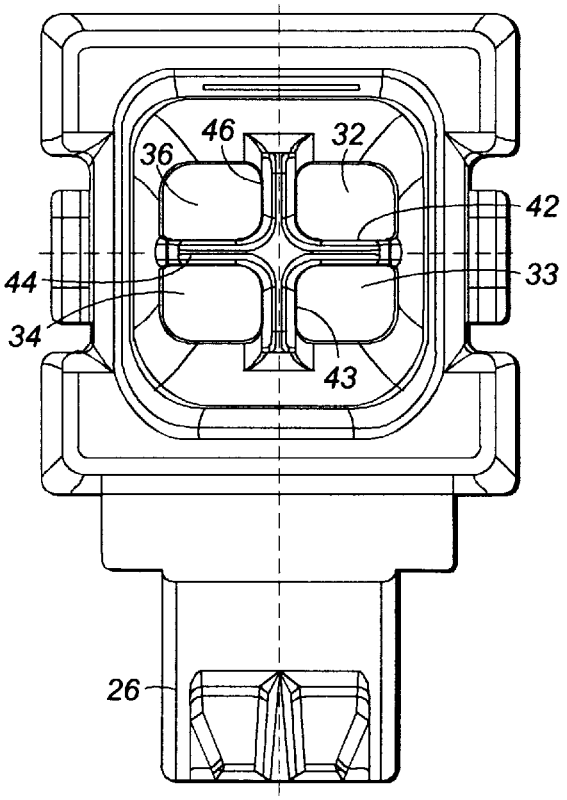
FIG. 6 is an elevation view of the rear of the strain relief plug.
Figure 7:
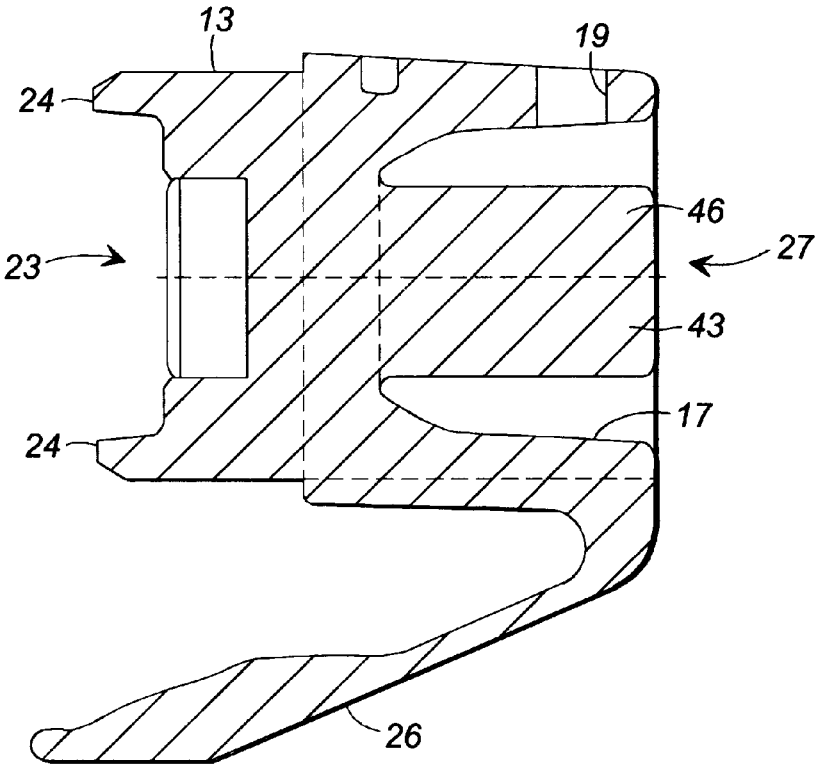
FIG. 7 is a cross-section view along the line A—A of FIG. 5.

FIG. 4 is a perspective view of the housing or plug 13 as viewed from the cable entrance end 27 thereof, and FIG. 6 is an elevation view thereof. As can be seen, extending from the rear face of divider 13 are four septa 42, 43, 44, and 46 which do not, as seen in FIG. 4, extend all the way to the interior walls of the interior bore 16, thereby forming gap 47 between their ends and the walls. The septa are arranged in a cruciform configuration, and form continuations of the channels formed by openings 32, 33, 34, and 36 in divider 31. The gaps 47 formed between the septa and the walls accommodate the cable jacket when it is inserted into bore 17, and the rear of divider 31 serves as a cable stop. Thus, when the cable is inserted into bore 17, each of the channels formed by the septa contains one pair of conductors which are untwisted from each other and substantially parallel. Inasmuch as the septa extend to the cable receiving or entrance end 27 the conductors are separated over a considerable distance as compared to the prior art. In addition, pairs of conductors are separated and substantially isolated from one another along virtually the entire length of housing 13. FIG. 7 is a cross-sectional elevation view along the line A—A of FIG. 5, where it can be seen that septa 43 and 46 extend to the cable receiving end face 27. Bore 17 is tapered as shown, gradually narrowing in dimension from the end 27 toward the end 23. The purpose and function of this taper will be more apparent hereinafter.

Compression Ring

Figure 8:
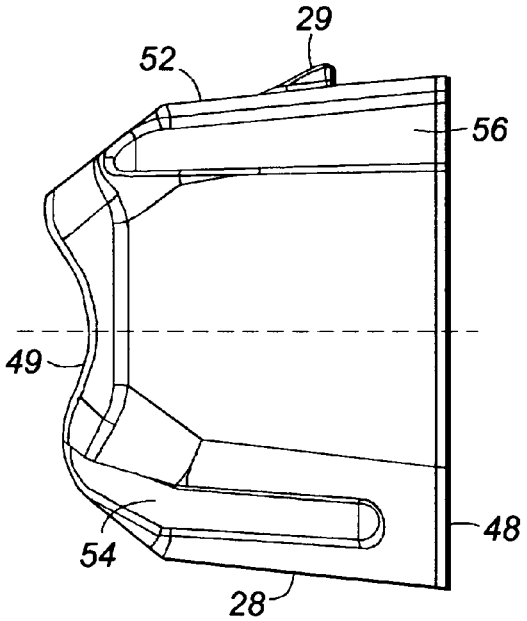
FIGS. 8, 9, 10, and 11 are, respectively, a side elevation view, a front elevation view, a rear elevation view, and a plan view of the anchoring member or compression ring of the invention.
Figure 9:
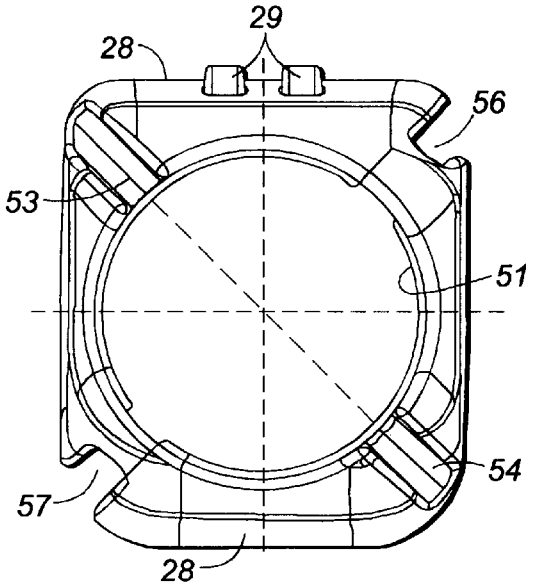
Figure 10:
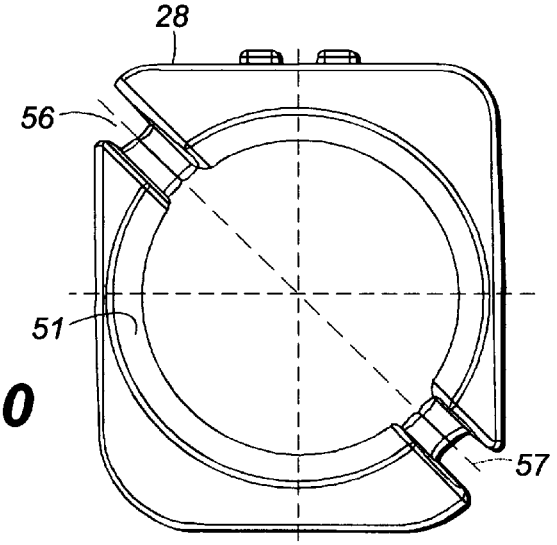
Figure 11:
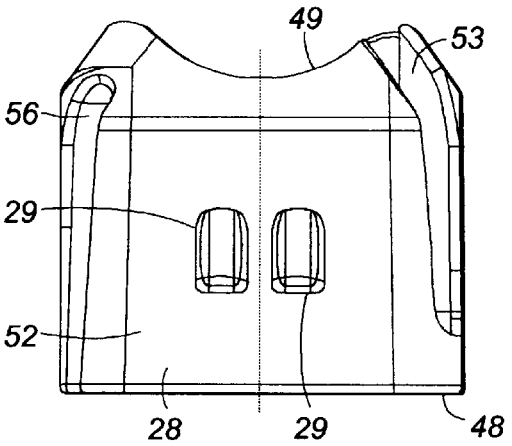
Figure 12:
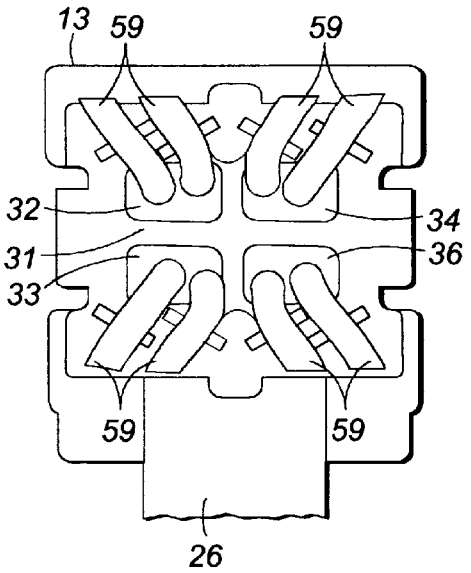
FIG. 12 is a diagrammatic view of the front face of the plug with insulated conductors in place.
Figure 13:
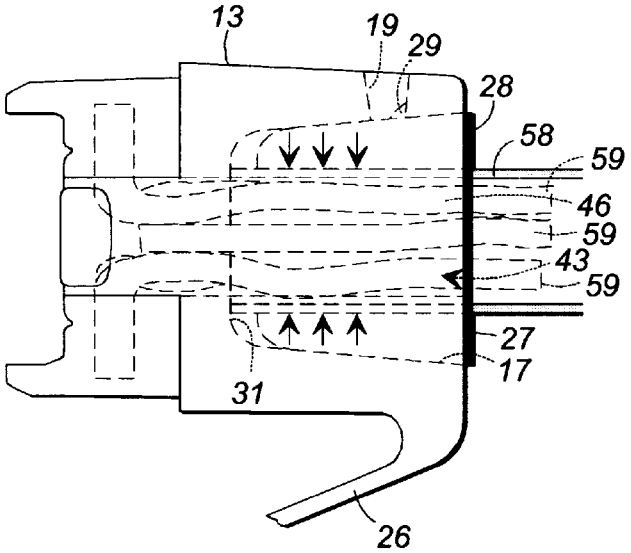
FIG. 13 is a diagrammatic view of the side of the plug with the cable and conductors in place.

FIGS. 8, 9, 10, and 11 are, respectively, a side elevation view; a front elevation view; a rear elevation view; and a top plan view of compression ring 28, which is preferably made of a suitable plastic material such as a polycarbonate. Ring 28 has a rear end 48 and a front end 49 and an axial circular bore 51 extending therethrough, which forms a peripheral wall between the bore and the exterior of the ring 28, and which is dimensioned to receive the cable to be terminated, as represented by the dashed lines in FIG. 8. The ring 28, which has a substantially rectangular external shape, tapers from the rear face 48 towards the front face 49, with the front face edges being slightly radiused or rounded as best seen in FIGS. 8 and 11. On the top surface 52 of ring 28 are first and second wedge shaped latch projections 29 which are adapted to engage the edge of opening 19 in the top surface 18 of housing 13 for the purpose of securing ring 28 within the tapered bore 17 of housing 13. While wedge shaped latches are shown, other means of securing the ring 28 within the bore 17, such as spring or cantilevered latches, for example, might be used, as well as a latch reversal with latches in the bore 17 of housing 13 and latch openings in ring 28. Extending from front face 49 toward the rear of ring 28 are first and second diametrically opposed slots 53 and 54, which, as can be seen, do not extend all the way to the rear face 48. Slots 53 and 54 are cut through the walls of ring 28 to communicate with bore 51. In like manner, third and fourth diametrically opposed slots 56 and 57 which extend from rear face 48 toward the front face 49, but stop short thereof, as seen in FIGS. 8 and 11. Slots 56 and 57, which are preferably, although not necessarily, spaced ninety degrees (90°) from slots 53 and 54, respectively, also extend through the walls of ring 28 to communicate with bore 51. The slots 53, 54, 56, and 57 impart a degree of flexibility, or more properly, enhanced compressibility, to ring 28 so that, as it is pushed forward into tapered bore 17 of member 13, it is compressed uniformly around the cable which it surrounds, until the latching members 29 engage the edge of opening 19. This process can be more readily seen with reference to FIGS. 12 and 13, which are diagrammatic views of housing 13 and ring 28 as assembled with a cable 58 and its insulated conductors 59 inserted therein. FIGS. 12 and 13 make clear the unique features of the present invention especially where compared to FIGS. 14 and 15, which represent the arrangement of the Chapman et al. application Ser. No. 08/822,621, which uses an anchor bar.

Figure 14:
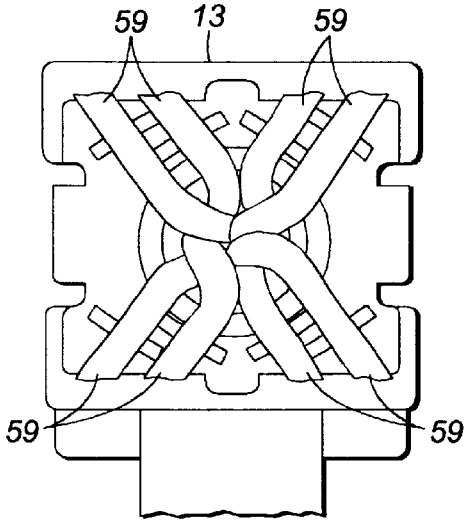
FIG. 14 is a diagrammatic view of the front face of a prior strain relief plug.
Figure 15:
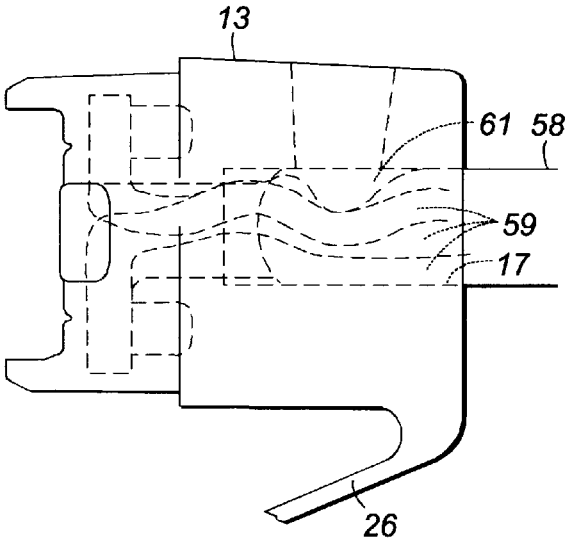
FIG. 15 is a diagrammatic view of the side of the prior plug of FIG. 14.

In FIGS. 14 and 15, it can be seen that the conductors 59 (for simplicity, the same reference numerals are used for the same or similar parts) emerge from the end of cable 58 in a forward region of housing 13. Inasmuch as the conductors 59 within the cable 58 are arranged as twisted pairs, and the pairs themselves are twisted together, the particular conductor arrangement at the cable end is not predictable and, further, there is insufficient space in which to organize the conductors for optimum results. Consequently, the conductors remain twisted and centrally grouped up to the point where they are fanned out to the four corners, as best seen in FIG. 14. Such an organization of conductors can result in undesirably high crosstalk levels. One reason for this extension of the cable end toward the front of the housing 13 is the anchor bar 61 which anchors the cable 58 within member 13 by exerting pressure on the cable to force it tightly against the opposite interior wall of bore 17. This has the effect of squeezing the twisted conductors 59 tightly against each other and the side of the cable which in turn is squeezed tightly against the wall of bore 17. Such an anchor bar arrangement works quite well with ribbon cable, but can produce undesirable variations in the transmission characteristics of the cable and connector when the cable is circular and contains numerous twisted pairs of conductors. It can be readily appreciated that the arrangement shown in FIG. 15 can produce unpredictable increases in crosstalk. Compensation for crosstalk can be accomplished by special arrangements of the lead frames in the jack interface housing. However, wide variations in crosstalk from connector to connector or, more particularly, from strain relief housing to strain relief housing, make it difficult to optimize or even to manage, crosstalk compensation.

The arrangement of the invention, as depicted in FIGS. 12 and 13, by means of divider 12 and openings 32, 33, 34, and 36 facilitates an organization of the conductor pairs, and the individual conductors regardless of at what point they are emergent from the cable. The septa 42, 43, 44, and 46 penetrate into the cable, as seen in FIG. 13, hence the conductors are routed along their designated channels over practically the entire length of member 13, thereby separating and segregating the conductor pairs and the conductors. Compression ring 28 applies a clamping force to the cable, as indicated by the arrows in FIG. 13 that is uniform about the circumference thereof, and the septa function to prevent the pairs from being squeezed together, a condition depicted in FIG. 15. Cable clamping or anchoring is, therefore, achieved without disturbing the orderly arrangement of the conductors and conductor pairs. As a consequence, even though crosstalk may not be completely eliminated, what crosstalk there is, is substantially non-varying from connector to connector and hence there is a large increase in predictability of transmission characteristics.

In concluding the detailed description, it should be noted that it will be obvious to those skilled in the art that many variations and modifications may be made to the preferred embodiment without substantial departure from the principles of the present invention. All such variations and modifications are intended to be included herewith as being within the scope of the present invention, as set forth in the claims hereinafter. Further, in the claims, the corresponding structures, materials, acts and equivalents of all means or step plus function elements are intended to include any structure, material, or acts for performing the functions with other claimed elements as specifically claimed.

What is claimed is:

1. A cable anchoring member for use in a strain relief plug of a communication cable connector, the strain relief plug having a bore extending therethrough, said cable anchoring member comprising:

a longitudinal member having an axial bore extending therethrough and an exterior surface, said exterior surface having at least one latching member thereon and being adapted for insertion within the bore of the strain relief plug such that engagement of said latching member with the strain relief plug secures said longitudinal member within the bore of the strain relief plug;

said longitudinal member having front and rear faces at the ends thereof;

said axial bore being dimensioned to receive a cable therein, and defining walls between said exterior surface and said axial bore; and at least one slot in at least one of said walls extending from one of said faces toward the other of said faces over a portion of the length of said longitudinal member, said slot being cut through said one wall to communicate with said axial bore.

2. A cable anchoring member as claimed in claim 1 wherein said exterior surface is tapered from a large cross-section at said rear face end to a smaller cross-section at said front face end.

3. A cable anchoring member as claimed in claim 2 wherein said exterior surface has two latching members thereon in side-by-side spaced relationship.

4. A cable anchoring member as claimed in claim 2 wherein said latching member is a projecting member on said exterior surface.

5. A cable anchoring member as claimed in claim 1 and further having additional spaced slots extending from one of said faces toward the other of said faces along a portion of the length of said member, each of additional slots extending through its corresponding wall to communicate with said axial bore, said slots forming an array of slots about the periphery of said exterior surface.

6. A cable anchoring member as claimed in claim 5 wherein said slots forming said array are spaced approximately ninety degrees apart from each other about the periphery of said exterior surface.

7. A cable anchoring member as claimed in claim 5 wherein alternate ones of said slots in said array extend from a different one of said front and rear faces toward the other of said faces, each of said slots having a length less than the length of said anchoring member.

8. For use in strain relief plug of a communication cable connector wherein the strain relief plug has a tapered central bore extending therethrough which diminishes in size from a cable receiving end to a connector end of the strain relief plug, the strain relief plug further having latching means therein for latching a cable anchoring member thereto, said cable anchoring member comprising:

a body member having an exterior dimensioned to fit within the central bore of the strain relief plug and having a front and rear face at the ends thereof, said exterior having at least one latching member thereon and being adapted for insertion within the central bore of the strain relief plug such that engagement of said latching member with the strain relief plug secures said body member within the central bore of the strain relief plug;

an axial bore extending through said body member from said front face to said rear face forming a peripheral wall portion between said exterior and said axial bore;

said exterior being tapered from said rear face to said front face; and a plurality of slotted openings between said exterior and said axial bore arrayed about said body member, alternate ones of said plurality of slotted openings extending in opposite directions from said front face toward said rear face and from said rear face toward said front face, each of said plurality of slotted openings having a length less than the length of said body member from said front face to said rear face.

9. A cable anchoring member as claimed in claim 8 wherein there are four of said slotted openings spaced at ninety degree intervals about said body member.

10. A cable anchoring member as claimed in claim 8 wherein said latching member comprises at least one wedge-shaped projection.

11. A cable anchoring member as claimed in claim 8 wherein said latching member comprises first and second wedge-shaped projections spaced from each other.

12. A cable anchoring member as claimed in claim 8 wherein said exterior is rounded-over adjacent said front end such that said exterior of said front end forms a curvilinear surface.

13. A cable anchoring member for use in a strain relief plug of a communication cable connector, the communication cable connector for receiving a cable, the strain relief plug having a bore extending therethrough, said cable anchoring member comprising:

a longitudinal member having an axial bore extending therethrough and an exterior surface, said exterior surface has at least one latching member thereon and is adapted for insertion within the bore of the strain relief plug such that engagement of said at least one latching member with the strain relief plug secures said longitudinal member within the bore of the strain relief plug;

said longitudinal member having front and rear faces at the ends thereof;

said axial bore being dimensioned to receive the cable therein, and defining walls between said exterior surface and said axial bore; and at least one slot in at least one of said walls extending from one of said faces toward the other of said faces over a portion of the length of said longitudinal member, said slot being cut through said one wall to communicate with said axial bore;

said longitudinal member being configured to clamp the cable with a uniform force about a circumference thereof and to secure itself within the bore of the strain relief plug.

14. The cable anchoring member of claim 13, wherein the cable has wire pairs, and said longitudinal member is configured to prevent the wires pairs from being squeezed against each other.

* * * * *